US011565535B2

(12) United States Patent
Kemma

(10) Patent No.: US 11,565,535 B2
(45) Date of Patent: Jan. 31, 2023

(54) HEATING DEVICE AND HEATING METHOD

(71) Applicant: Tsuguyori Kemma, Kanagawa (JP)

(72) Inventor: Tsuguyori Kemma, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 867 days.

(21) Appl. No.: 16/514,659

(22) Filed: Jul. 17, 2019

(65) Prior Publication Data

US 2020/0032452 A1 Jan. 30, 2020

(30) Foreign Application Priority Data

Jul. 27, 2018 (JP) ..... JP2018-141764

(51) Int. Cl.

| | |
|---|---|
| ***F26B 3/00*** | (2006.01) |
| ***B41J 11/00*** | (2006.01) |
| ***D06P 5/24*** | (2006.01) |
| ***D06P 5/20*** | (2006.01) |

(52) U.S. Cl.

CPC .... *B41J 11/00242* (2021.01); *B41J 11/00244* (2021.01); *D06P 5/003* (2013.01); *D06P 5/2072* (2013.01); *F26B 3/00* (2013.01)

(58) Field of Classification Search

CPC ..... B41J 11/00242; B41J 11/00244; D06P 5/003; D06P 5/2072; D06P 5/30; F26B 3/00

USPC ..... 219/385

See application file for complete search history.

(56) References Cited

U.S. PATENT DOCUMENTS

| | | | | |
|---|---|---|---|---|
| 6,092,891 | A | 7/2000 | Okubo et al. | |
| 6,151,040 | A * | 11/2000 | Takada | B41J 2/04528 347/14 |
| 2010/0066783 | A1 * | 3/2010 | Navazo | B41J 11/0024 347/17 |
| 2013/0027486 | A1 | 1/2013 | Yamaguchi | |
| 2013/0257986 | A1 | 10/2013 | Yanase et al. | |
| 2017/0320316 | A1 | 11/2017 | Nakamura et al. | |
| 2018/0105979 | A1 | 4/2018 | Matsumoto | |

FOREIGN PATENT DOCUMENTS

| | | | |
|---|---|---|---|
| JP | 2001205792 | A | 7/2001 |
| JP | 2016160341 | A | 9/2016 |
| JP | 2018-066097 | | 4/2018 |
| JP | 2018066093 | A * | 4/2018 |
| JP | 2018-084013 | | 5/2018 |
| WO | 2018074612 | A1 | 4/2018 |

* cited by examiner

*Primary Examiner* — John P McCormack

(74) *Attorney, Agent, or Firm* — Duft & Bornsen, PC

(57) ABSTRACT

A heating device includes a holder, a receiver, a heating unit, a vertical mover, and circuitry. The holder holds a heating target object. The receiver removably holds the holder. The heating unit heats the heating target object. The vertical mover moves at least one of the receiver and the heating unit vertically relative to each other, between a non-contact heating position and a contact heating position. The circuitry causes the vertical mover to move the at least one of the receiver and the heating unit to the non-contact position, causes the heating unit to heat the heating target object in a non-contact state, causes the vertical mover to move the at least one of the receiver and the heating unit to the contact heating position, and causes the heating unit to heat the heating target object in a contact state.

10 Claims, 13 Drawing Sheets

HEATING DEVICE AND HEATING METHOD

CROSS-REFERENCE TO RELATED APPLICATION

This patent application is based on and claims priority pursuant to 35 U.S.C. § 119(a) to Japanese Patent Application No. 2018-141764, filed on Jul27, 2018, in the Japan Patent Office, the entire disclosure of which is hereby incorporated by reference herein.

BACKGROUND

Technical Field

This disclosure relates to a heating device and a heating method.

Related Art

A heating device, which heats a fabric on which an image is printed by applying liquid in a printing device, is known to include a unit that vertically moves a receiving member that retains a cassette to hold the fabric. Such a heating device moves the unit between a standby position at which a holding member is inserted or removed, a non-contact heating position at which a heating unit heats the fabric while the heating unit is separated from the fabric, and a contact heating position at which the heating unit heats the fabric while the heating unit is in contact with the fabric.

SUMMARY

At least one aspect of this disclosure provides a heating device including a holder, a receiver, a heating unit, a vertical mover, and circuitry. The holder is configured to hold a heating target object. The receiver is configured to removably hold the holder. The heating unit is configured to heat the heating target object held by the holder. The vertical mover is configured to move at least one of the receiver and the heating unit vertically relative to each other. The vertical mover is configured to relatively move the at least one of the receiver and the heating unit between a non-contact heating position at which the heating object target is heated while the heating target object is separated away from the heating unit and a contact heating position at which the heating target object is heated while the heating target object is in contact with the heating unit. The circuitry is configured to control the heating unit. The circuitry is configured to cause the vertical mover to move the at least one of the receiver and the heating unit to the non-contact position, causes the heating unit to heat the heating target object in a non-contact state in which the at least one of the receiver and the heating unit is at the non-contact heating position, causes the vertical mover to move the at least one of the receiver and the heating unit from the non-contact heating position to the contact heating position, and causes the heating unit to heat the heating target object in a contact state in which the at least one of the receiver and the heating unit is at the contact heating position.

Further, at least one aspect of this disclosure provides a heating method including rotating a device operator, moving at least one of a receiver and a heating unit, with the device operator, to a non-contact heating position at which a heating target object is heated while the heating target object is separated away from the heating unit, heating the heating target object in a non-contact state in which the at least one of the receiver and the heating unit is at the non-contact heating position, moving the at least one of the receiver and the heating unit, with the drive operator, from the non-contact heating position to a contact heating position at which the heating target object is heated while the heating target object is in contact with the heating unit, and heating the heating target object in a contact state in which the at least one of the receiver and the heating unit is at the contact heating position.

BRIEF DESCRIPTION OF THE SEVERAL VIEWS OF THE DRAWINGS

An exemplary embodiment of this disclosure will be described in detail based on the following figured, wherein.

DETAILED DESCRIPTION

Figure 1:
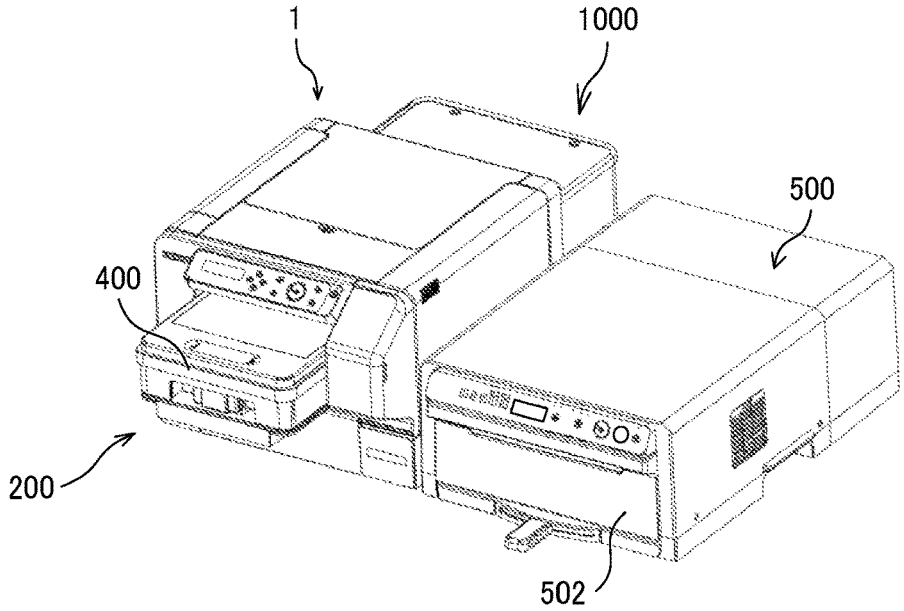
FIG. 1 is a perspective view illustrating an example of usage of an image applier (image applying system) including a heating device to perform a heating method according to an embodiment of this disclosure.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, a term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present disclosure.

The terminology used herein is for describing particular embodiments and examples and is not intended to be limiting of exemplary embodiments of this disclosure. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of this disclosure. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of this disclosure.

This disclosure is applicable to any heating device, and is implemented in the most effective manner in any inkjet image forming apparatus.

In describing preferred embodiments illustrated in the drawings, specific terminology is employed for the sake of clarity. However, the disclosure of this disclosure is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments of this disclosure are described.

Descriptions are given of an embodiment applicable to a heating device and a heating method performed with the heating device, with reference to the following figures.

It is to be noted that elements (for example, mechanical parts and components) having the same functions and shapes are denoted by the same reference numerals throughout the specification and redundant descriptions are omitted.

A description is given of an image applier (image applying system) according to this disclosure, with reference to FIG. 1.

FIG. 1 is a perspective view illustrating one example of the image applier according to this disclosure.

Further, size (dimension), material, shape, and relative positions used to describe each of the components and units are examples, and the scope of this disclosure is not limited thereto unless otherwise specified.

The image applier (image applying system) 1000 of FIG. 1 includes a cassette 200, a printer 1, and a heating device 500. The cassette 200 functions as a print target object holder and a heating target object holder. The cassette 200 is detachably attachable to the printer 1. The printer 1 prints an image on a fabric 400 that is also a printing target object (an object to be printed) held by the cassette 200. The cassette 200 is also detachably attachable to the heating device 500. The heating device 500 accommodates the fabric 400, which functions as a printing target object, together with the cassette 200 and heats the fabric 400 to fix the image to the fabric 400.

The printer 1 and the heating device 500 of the image applier 1000 are separate bodies, so that the printer 1 and the heating device 500 may be arranged side by side or may be stacked one on the other. It is to be noted that the printer 1 may be spaced apart from the heating device 500. The image applier 1000 can reduce the footprint of the image applier 1000 by stacking the printer 1 and the heating device 500.

When the image applier 1000 prints an image on the fabric 400, the cassette 200 that holds the fabric 400 is set (mounted) on the printer 1, so that the printer 1 can print the image on the fabric 400 successfully.

When the printer 1 finishes printing the image on the fabric 400, the cassette 200 that holds the fabric 400 is removed from the printer 1. Then, a front door 502 (e.g., a front cover) that functions as a door of the heating device 500 is opened to insert the cassette 200 that holds the fabric 400 after printing into the heating device 500. The front door 502 is closed to heat the fabric 400 together with the cassette 200 in the heating device 500. The image printed on the fabric 400 is fixed to the fabric 400 by heating the fabric 400 with the heating device 500.

Figure 2:
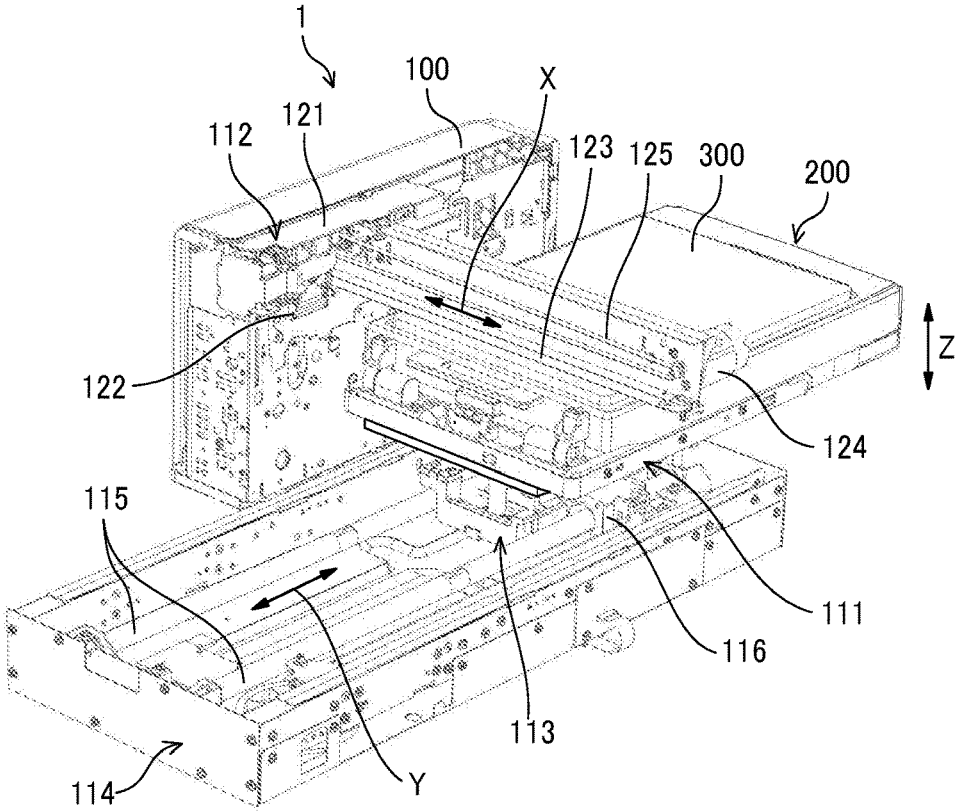
FIG. 2 is a perspective view illustrating an overall configuration of a mechanical section of a printer.
Figure 3:
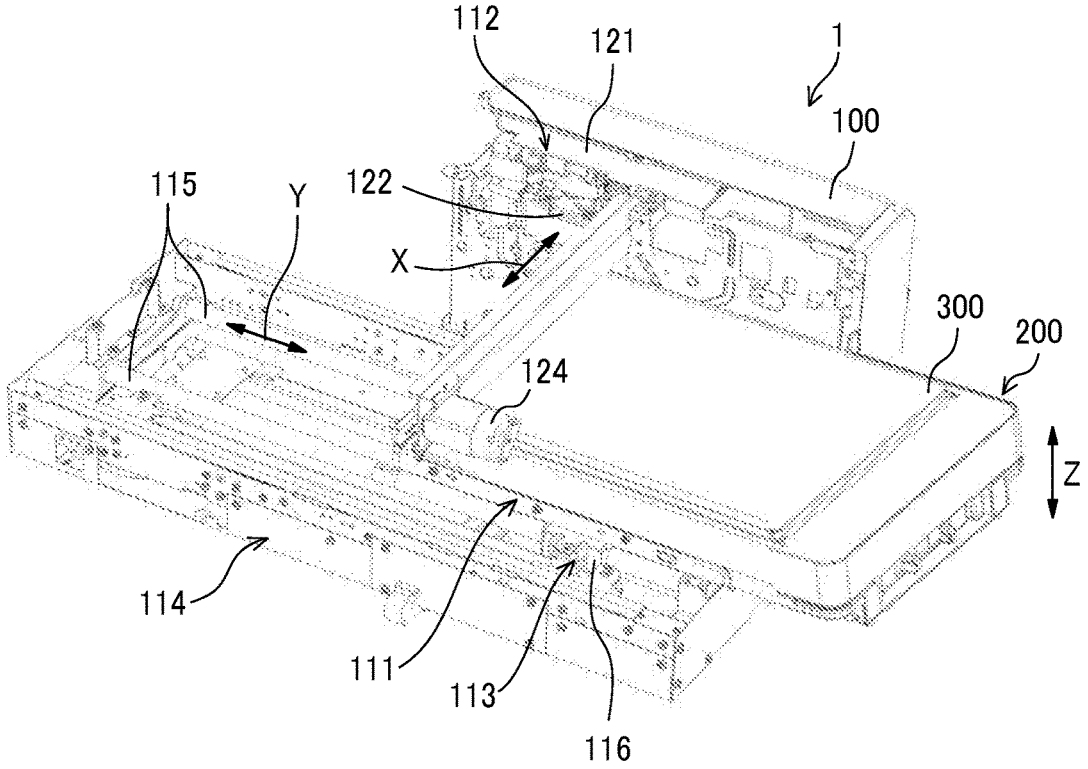
FIG. 3 is a perspective view illustrating the printer, viewed from an angle different from FIG. 2.

Next, a description is given of an example of the printer 1, with reference to FIGS. 2 and 3.

FIG. 2 is a perspective view illustrating an overall configuration of a mechanical section of the printer 1. FIG. 3 is a perspective view illustrating the printer 1, viewed from an angle different from FIG. 2.

The printer 1 includes a stage 111 and a printing section 112 in an apparatus body 100 of the image applier 1000. The stage 111 functions as a receiver that moves back and forth while detachably holding the cassette 200 that holds the fabric 400. The printing section 112 prints the image on the fabric 400 held by the cassette 200 that is held by the stage 111.

Here, not only the fabric 400 as a piece of cloth, such as a handkerchief and a towel, but also the fabric 400 processed as clothing, such as a T-shirt and a sweat shirt, and a part of a product, such as a tote bag, are applied to this disclosure.

The stage 111 is disposed to be movable in a direction indicated by arrow Y (i.e., a Y-direction corresponding to a feeding direction) along a conveyor 113.

Here, conveyance guides 115 are arranged along the Y-direction in a bottom housing 114 of the apparatus body 100. Slider portions 116 of the conveyor 113 are movably held by the conveyance guides 115.

The printing section 112 includes a carriage 121 and a head 122 included in the carriage 121. The carriage 121 moves in a direction indicated by arrow X (i.e., X-direction corresponding to a main scanning direction) with respect to the stage 111. The X-direction is perpendicular to the Y-direction.

The carriage 121 is movably held with a guide 123 that is disposed along the X-direction. A drive motor 124 moves the carriage 121 back and forth in the X-direction via a scanning mechanism such as a timing belt 125. The head 122 discharges ink onto a surface of a fabric using a liquid discharge head to form an image. However, the structure of the head 122 is not limited to the above-described structure.

The printer 1 mounts and holds the cassette 200 on the stage 111 in the apparatus body 100 while the fabric 400 is set on a platen 300 of the cassette 200. Then, a desired image is printed on the fabric 400 by repeating a reciprocal movement of the stage 111 in the Y-direction and a reciprocal movement of the head 122 (of the carriage 121) in the X-direction.

Here, the stage 111 is also elevated and lowered in a vertical direction, which is a Z-direction. The printer 1 adjusts a gap between the fabric 400 and the head 122 to a predetermined gap by elevating and lowering the stage 111 according to a thickness of the fabric 400. It is to be noted that the printing section 112 may be elevated and lowered. Next, a description is given of an example of the cassette 200 that functions as a holder (i.e., a print target object holder and a heating target object holder), with reference to FIGS. 4, 5, and 6.

Figure 4:
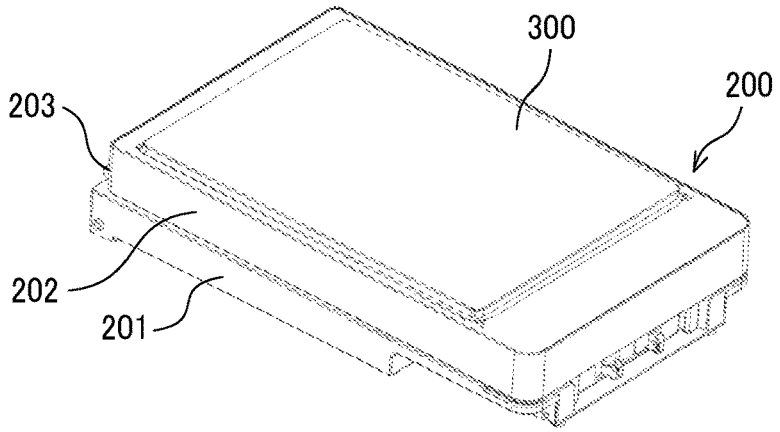
FIG. 4 is a perspective view illustrating an example of a cassette.
Figure 5:
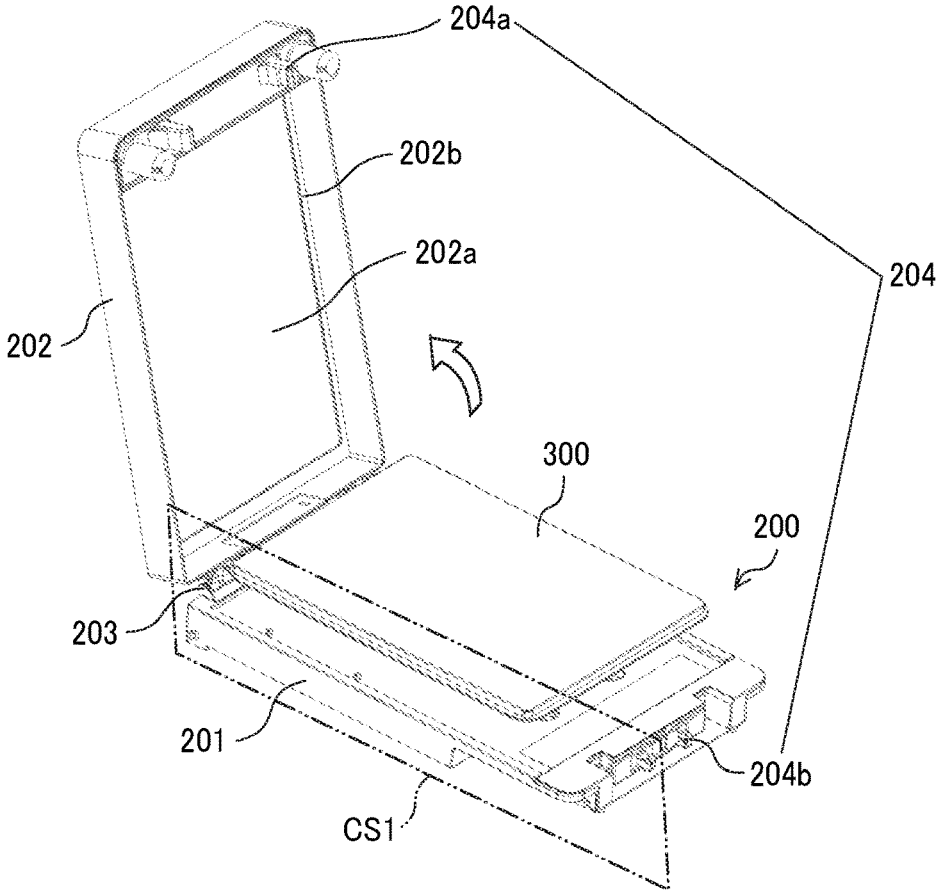
FIG. 5 is a perspective view illustrating a state in which an outer peripheral cover of the cassette of FIG. 4 is opened.
Figure 6:
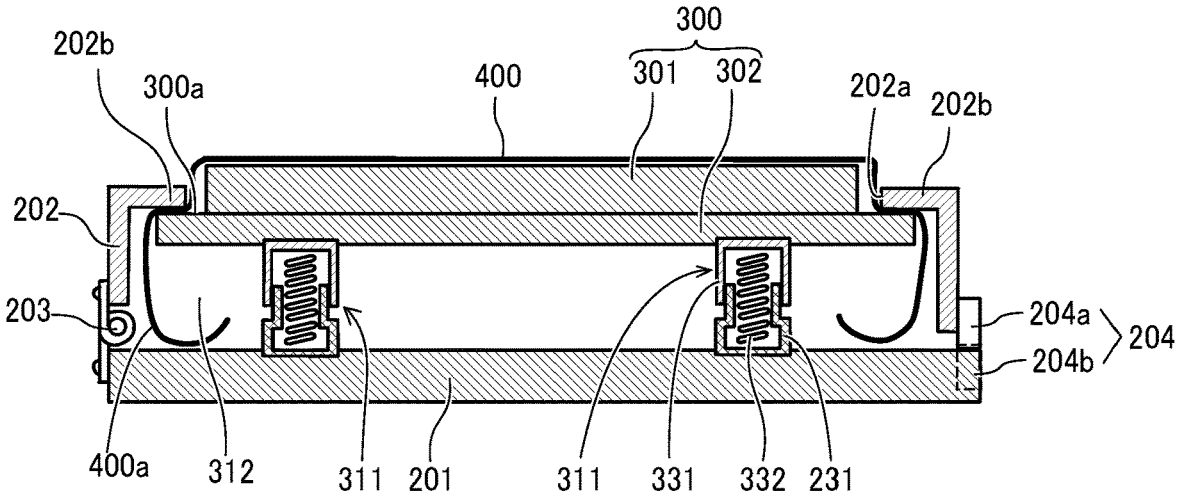
FIG. 6 is a schematic cross-sectional view illustrating the cassette in a longitudinal direction of the cassette cut along cross section in FIG. 5.

FIG. 4 is a perspective view illustrating the cassette 200. FIG. 5 is a perspective view illustrating a state in which an outer peripheral cover of the cassette 200 of FIG. 4 is opened. FIG. 6 is a schematic cross-sectional view illustrating the cassette 200 in a longitudinal direction of the cassette 200 cut along a cross section CS1 in FIG. 5.

The cassette 200 includes a base 201 and a platen 300. The platen 300 holds flat the portion of the fabric 400 on which an image is to be printed.

The platen 300 includes a platen structure 302 and a heat insulator 301 forming a surface for holding the fabric 400 in a flat state. The heat insulator 301 has heat resistance against heating by the heating device 500.

One end portion of an outer peripheral cover 202 is rotatably attached to the base 201 by a hinge 203. The outer peripheral cover 202 is openable and closable along a direction indicated by arrow relative to the base 201.

The outer peripheral cover 202 includes a frame 202*b* that forms an opening 202*a* at a portion corresponding to the platen 300. The outer peripheral cover 202 holds the fabric 400 between the frame 202*b* and a flange 300*a* that is an outer peripheral portion of the platen 300.

The platen 300 is supported on the base 201 by a support 311. An accommodation space 312 is formed between the platen 300 and the base 201 to accommodate a surplus portion 400*a* of the fabric 400. For example, when printing an image on a front side of a T-shirt, the surplus portion 400*a* corresponds to the sleeves, the collar, and the skirt of the T-shirt.

When setting the fabric 400 in the cassette 200, as illustrated in FIG. 5, the outer peripheral cover 202 is opened to set (hold) the fabric 400 on the platen 300. At this time, as illustrated in FIG. 6, the outer peripheral cover 202 is closed in a state in which the surplus portion 400*a* of the fabric 400 is accommodated in the accommodation space 312.

When printing an image on the fabric 400, the cassette 200 on which the fabric 400 is set is attached (set) on the stage 111 of the apparatus body 100 of the printer 1.

As described above, with the cassette 200 being entirely detached from the apparatus body 100, the fabric 400 that functions as a printing target object is set on the platen 300. Accordingly, the setting operation of the fabric 400 to the platen 300 is facilitated.

After the printer 1 finishes printing, the cassette 200 is set (transferred) to the heating device 500 while holding the fabric 400. The fabric 400 on which the image is printed is heated and fixed by the heating device 500.

In addition, in the cassette 200, the support 311 that supports the platen 300 includes a hollow support 231 disposed on the base 201 side, a hollow support 331 disposed on the platen 300 side and movably fitted to the hollow support 231, and a compression spring 313 disposed between the hollow support 231 and the hollow support 331.

Accordingly, the platen 300 is supported on the base 201 to be displaceable with the base 201.

The outer peripheral cover 202 includes lock claws 204*a*. Each of the lock claws 204*a* is disposed on a side of the outer peripheral cover 202 that is opposite to a support side of the outer peripheral cover 202 that is held by the hinge 203 to be openable and closable with respect to the base 201.

By contrast, the base 201 includes lock claw holders 204*b* to hold the lock claws 204*a* or releases holding of the lock claws 204*a*.

The lock claws 204*a* and the lock claw holders 204*b* form a locking unit 204 that regulates the height of the outer peripheral cover 202 covering the peripheral portion of the platen 300, with respect to the base 201.

Next, a description is given of an example of the heating device 500, with reference to FIGS. 7 through 11.

Figure 7:
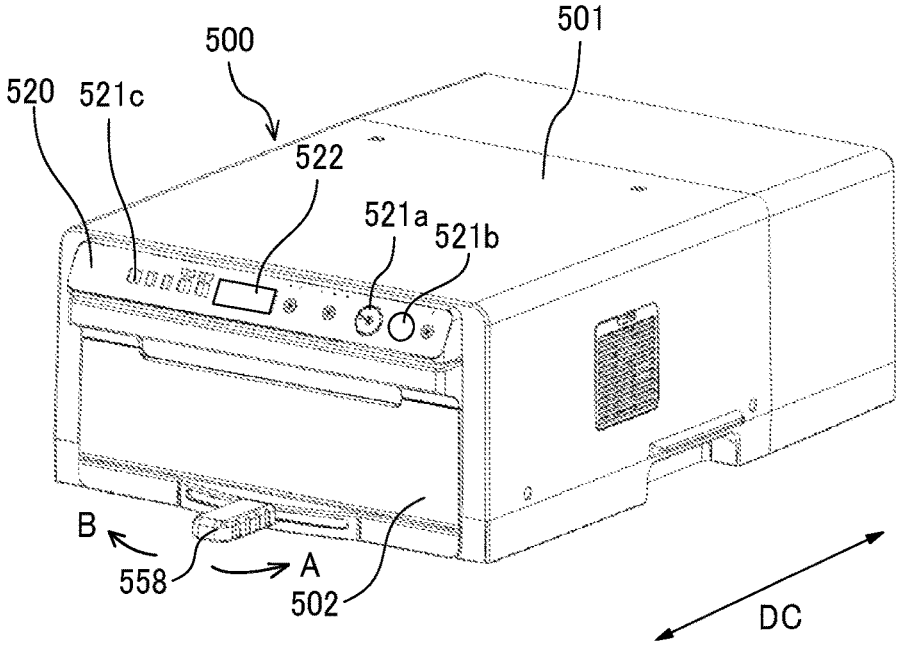
FIG. 7 is an external perspective view illustrating the heating device.
Figure 8:
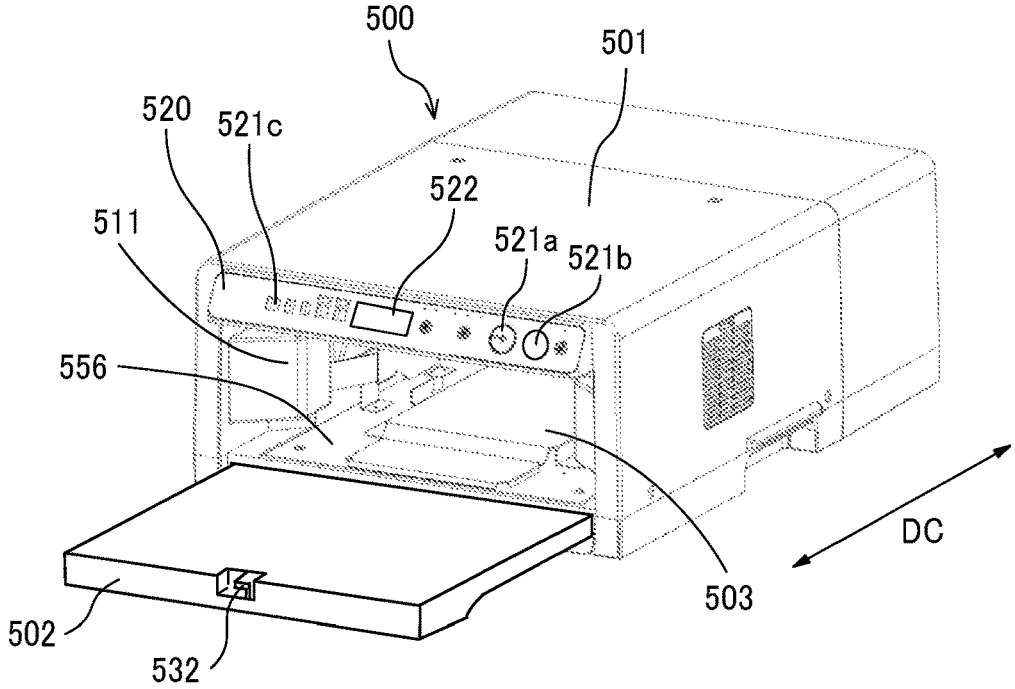
FIG. 8 is a perspective view illustrating a state in which a front door of the heating device is opened.
Figure 9:
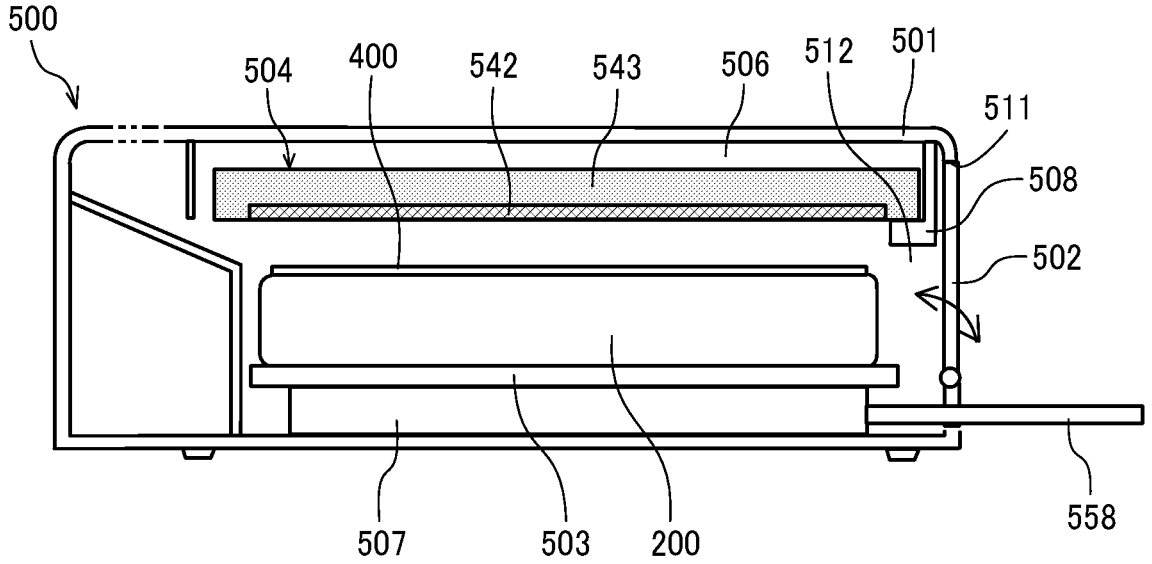
FIG. 9 is a schematic cross-sectional view illustrating the heating device cut along the longitudinal direction of the heating device (i.e., in a direction of insertion and removal of the cassette)
Figure 10A:
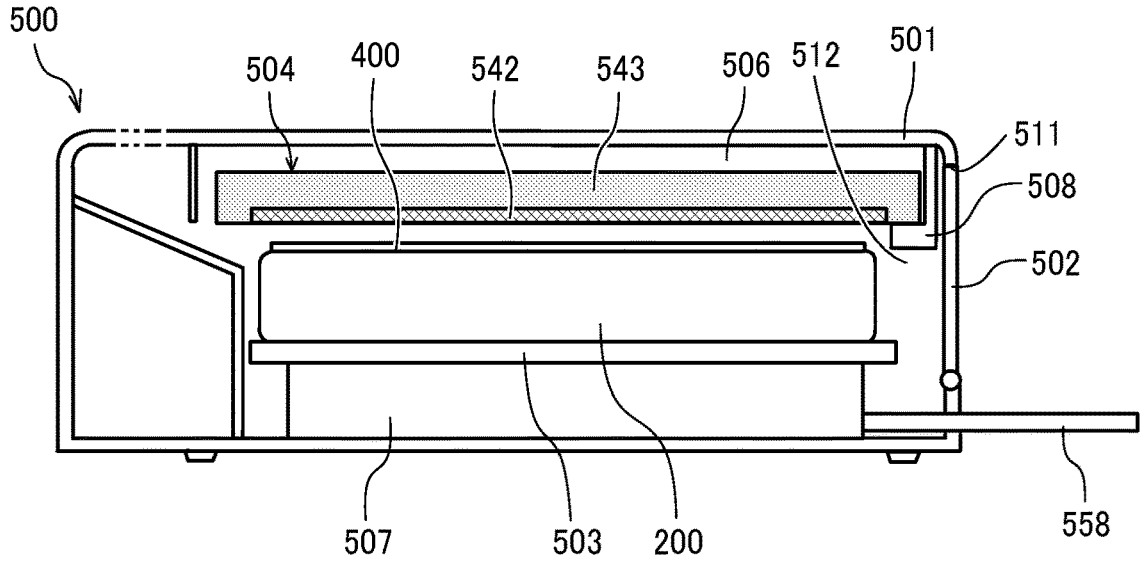
FIGS. 10A and 10B are schematic cross-sectional views illustrating the heating device cut along the longitudinal direction of the heating device (i.e., in the direction of insertion and removal of the cassette) to illustrate a usage form of the heating device.
Figure 10B:
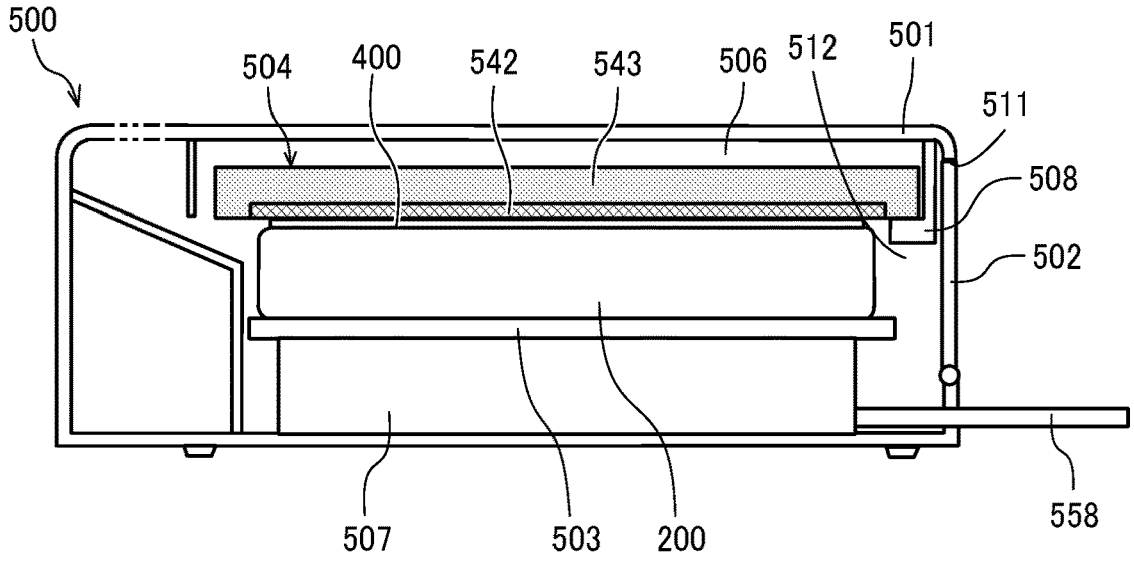
Figure 11:
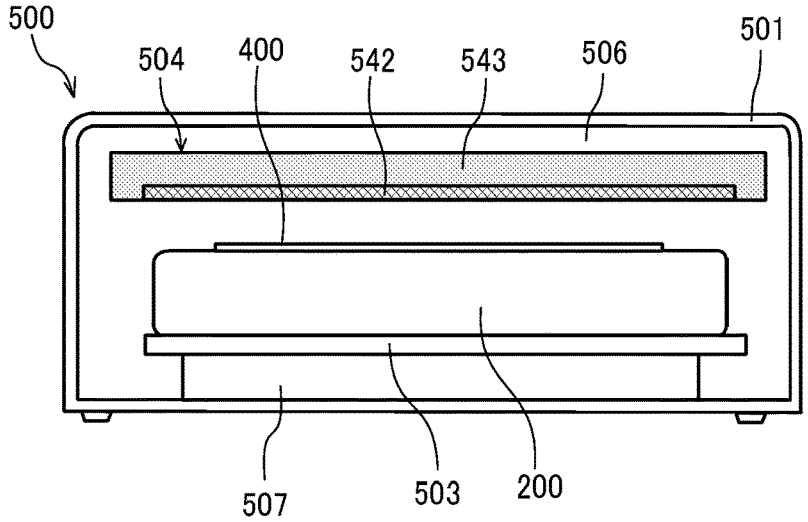
FIG. 11 is a schematic cross-sectional view illustrating the heating device cut along the lateral direction of the heating device (i.e., a direction perpendicular to the direction of insertion and removal of the cassette)

FIG. 7 is an external perspective view illustrating the heating device 500. FIG. 8 is a perspective view illustrating a state in which a front door of the heating device 500 is opened. FIG. 9 is a schematic cross-sectional view illustrating the heating device 500 cut along the longitudinal direction of the heating device 500, i.e., in a direction, indicated by arrow DC, of insertion and removal of the cassette 200. FIGS. 10A and 10B are schematic cross-sectional views illustrating the heating device 500 cut along the longitudinal direction of the heating device 500 (i.e., in the direction DC of insertion and removal of the cassette) to illustrate a usage form of the heating device 500. FIG. 11 is a schematic cross-sectional view illustrating the heating device 500 cut along the lateral direction of the heating device 500 (i.e., a direction perpendicular to the direction DC of insertion and removal of the cassette 200).

The heating device 500 includes a device body 501 and the front door 502 (e.g., the front cover). The front door 502, that functions as a door for an opening 511, opens and closes the opening 511 of the device body 501 through which the cassette 200 is inserted and removed.

The front door 502 is openable and closable in directions indicated by arrow in FIG. 9. The front door 502 opens to fall, as illustrated in FIG. 8. By opening the front door 502, the cassette 200, which is a heating target object holder that holds the fabric 400 that functions as a heating target object, is inserted into or removed from the device body 501 through the opening 511.

A receiver 503 (e.g., a table) is disposed inside the device body 501. The receiver 503 detachably mounts the cassette 200, which functions as a heating target object holder to the fabric 400 inside the device body 501.

Similar to the stage 111 of the printer 1, the receiver 503 is a holder to which the cassette 200 is removably attached (held) or the receiver 503 is a table on which the cassette 200 is simply placed.

Here, the receiver 503 corresponds to a table.

A heating unit 504 is disposed above the receiver 503, to face the fabric 400 held by the cassette 200 and heat the fabric 400.

The heating unit 504 includes a heater 542 and a heat insulator 543. The heater 542 functions as a heater that is disposed facing the fabric 400 held by the cassette 200. The heat insulator 543 thermally insulates heat from the heater 542 to the opposite side to the receiver 503. A space 506 is provided between the heat insulator 543 and the inner wall face of device body 501.

The surface of the heater 542 facing the receiver 503 is configured to be positioned substantially parallel to an exposed surface of the fabric 400 held by the cassette 200 that is set on the device body 501.

It is to be noted that a planar member formed of a material having excellent thermal conductivity such as aluminum may be provided on the receiver 503 side of the heater 542. Thus, the heater 542 with the planar member heats the fabric 400 such that a surface temperature of the fabric 400 becomes substantially uniform from the heat generated by the heater 542. In this way, the heating device 500 can heat the fabric 400 at approximately the same temperature in a plane (along a surface) of the fabric 400 regardless of the heating position of the heater 542.

A holding member 508 holds the heating unit 504 on the opening 511 side of device body 501. In the present embodiment, an insertion opening 512 through which the cassette 200 is inserted is provided below the holding member 508. However, when the upper end of the opening 511 of the device body 501 is positioned below the lower end of the holding member 508, the opening 511 serves as the insertion opening 512.

The receiver 503 is held by a vertical mover (lifting mechanism) 507 that is an elevator. The receiver 503 is relatively movable in three steps in the vertical direction (i.e., a direction in which the relative distance changes) with respect to the heating unit 504.

The vertical mover 507 includes an operation lever 558 that functions as a device operator. The receiver 503 is moved vertically as the operation lever 558 is moved to a neutral position as illustrated in FIG. 7, in a direction indicated by arrow A in FIG. 7, or in a direction indicated by arrow B.

Here, when the operation lever 558 is at the neutral position, the relative position of the receiver 503 with respect to the heating unit 504 is at a standby position (i.e., a first position) illustrated in FIG. 9. When the operation lever 558 is rotated in the direction indicated by arrow A, the relative position of the receiver 503 with respect to the heating unit 504 is changed to a non-contact heating position (i.e., a second position) illustrated in FIG. 10A. When the operation lever 558 is rotated in the direction indicated by arrow B, the relative position of the receiver 503 with respect to the heating unit 504 is changed to a contact heating position (i.e., a third position) illustrated in FIG. 10B.

The standby position illustrated in FIG. 9 is a position that allows the user to insert the cassette 200 into the device body 501 and remove the cassette 200 from the device body 501. The non-contact heating position illustrated in FIG. 10A is a heating position at which the fabric 400 is heated by the heating unit 504 in a non-contact state (in other words, the fabric 400 is heated without contacting the heating unit 504). The contact heating position illustrated in FIG. 10B is a heating position at which the fabric 400 is heated by the heating unit 504 in a contact state (in other words, the fabric 400 is heated while contacting the heating unit 504).

Further, referring to FIG. 7, the control panel 520 includes a self-luminous pre-heat start key (button) 521*a* to indicate the start of pre-heating, a stop (fixing) key (button) 521*b* to indicate the stop of heating, a heating-in-progress display 521*c* to display that a heating operation is being performed, and a message display unit 522.

Figure 12:
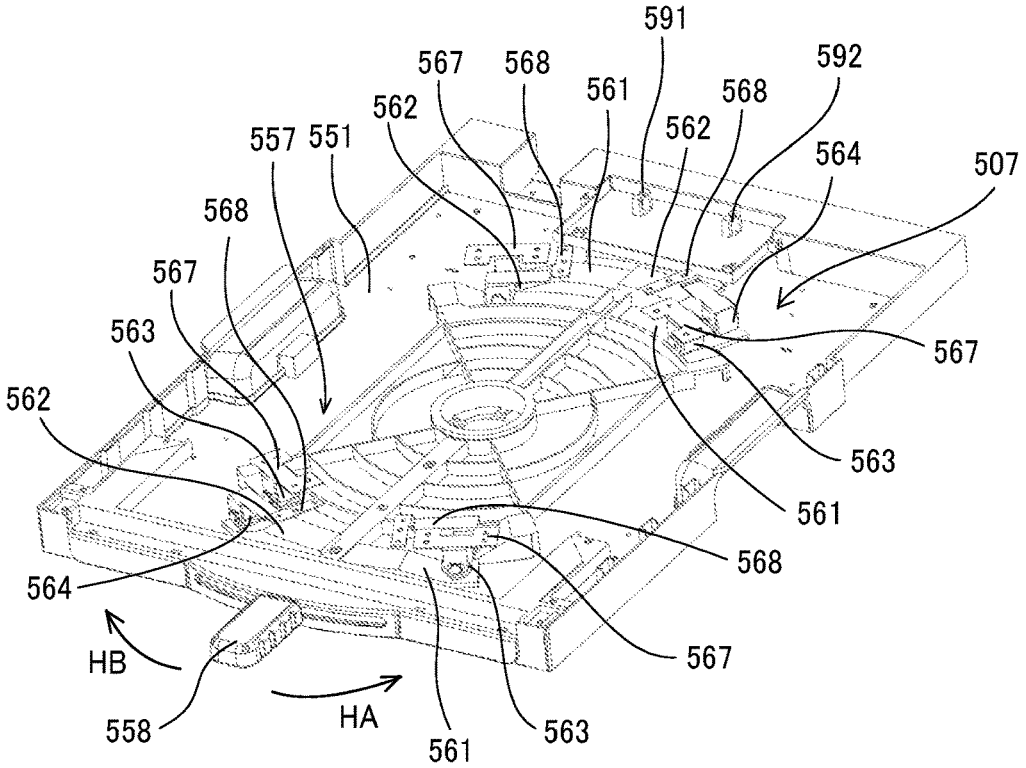
FIG. 12 is a perspective view illustrating an example of a vertical mover provided to the heating device.
Figure 13:
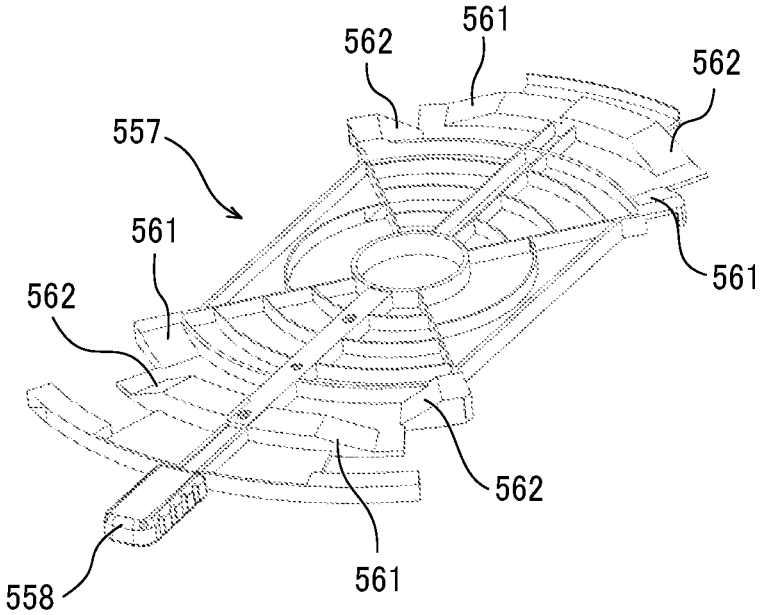
FIG. 13 is a perspective view illustrating a portion of a cam mechanism in the vertical mover.

Next, a description is given of an example of a vertical mover, with reference to FIGS. 12 and 13.

FIG. 12 is a perspective view illustrating an example of a vertical mover provided to the heating device 500. FIG. 13 is a perspective view illustrating a portion of a cam mechanism in the vertical mover.

The receiver 503 is held on the vertical mover 507.

The vertical mover 507 includes a holding table 556 that holds the receiver 503 and a cam mechanism 557 that vertically moves the holding table 556.

The cam mechanism 557 includes the operation lever 558 that functions as a position switching lever rotatably held in a horizontal direction on a bottom plate 551 of the device body 501.

The operation lever 558 is provided with a first inclined cam portion 561 and a second inclined cam portion 562, having different heights from each other. The height of the uppermost surface of the first inclined cam portion 561 is lower than a height of the uppermost surface of the second inclined cam portion 562.

By contrast, a first roller 563, a second roller 564, and roller holders 567 and 568 are provided on a base surface of the holding table 556 of the vertical mover 507. The first roller 563 follows the first inclined cam portion 561. The second roller 564 follows the second inclined cam portion 562. The roller holders 567 and 568 are fixed on a bottom surface of the holding table 556. The roller holder 567 rotatably holds the first roller 563. The roller holder 568 rotatably holds the second roller 564. The holding table 556 is held on the cam mechanism 557 via the first roller 563 and the second roller 564.

Here, as illustrated in FIG. 12, the operation lever 558 is rotated in the direction indicated by arrow HA (i.e., a direction HA) with respect to a standby position, which is a center position of the operation lever 558. Then, the first roller 563 rides on the first inclined cam portion 561. As a result, the holding table 556 is raised to the height of the first inclined cam portion 561, and the receiver 503 is lifted from the standby position to the non-contact heating position.

Similarly, the operation lever 558 is rotated in the direction indicated by arrow HB (i.e., a direction HB) from the standby position, i.e., the center position of the operation lever 558. Then, the second roller 564 rides on the second inclined cam portion 562. As a result, the holding table 556 is raised to the height of the second inclined cam portion 562, and the receiver 503 is lifted from the standby position to the contact heating position.

In this way, the holding table 556 moves vertically by operating (rotating) the operation lever 558. Thus, a height of the cassette 200 placed on the receiver 503 held on the holding table 556 also changes. Therefore, an operation (rotation) of the operation lever 558 changes a gap (i.e., the relative distance) or a pressing force between the fabric 400 and the heating unit 504.

Further, as illustrated in FIG. 12, the vertical mover 507 further includes a first detector 591 and a second detector 592. The first detector 591 detects the operation lever 558 when the operation lever 558 is rotated in the direction HA until the receiver 503 reaches the non-contact heating position. The second detector 592 detects the operation lever 558 when the operation lever 558 is rotated in the direction HB until the receiver 503 reaches the contact heating position.

It is to be noted that, in the present embodiment, the receiver (i.e., the receiver 503) is disposed movable in the vertical direction with respect to the heating unit (i.e., the heating unit 504). However, the configuration is not limited to the above-described configuration. For example, this disclosure is applicable to a configuration in which a heating unit is disposed movable in the vertical direction with respect to a receiver or a configuration in which a receiver is disposed movable in the vertical direction with respect to a heating unit and simultaneously the heating unit is disposed movable in the vertical direction with respect to the receiver. In other words, the vertical mover (i.e., the vertical mover 507) is configured to move at least one of the receiver and the heating unit, relative to each other. In other words, this disclosure is applied to a configuration in which at least one of a receiver and a heating unit is moved relative to each other in the vertical direction.

Figure 14:
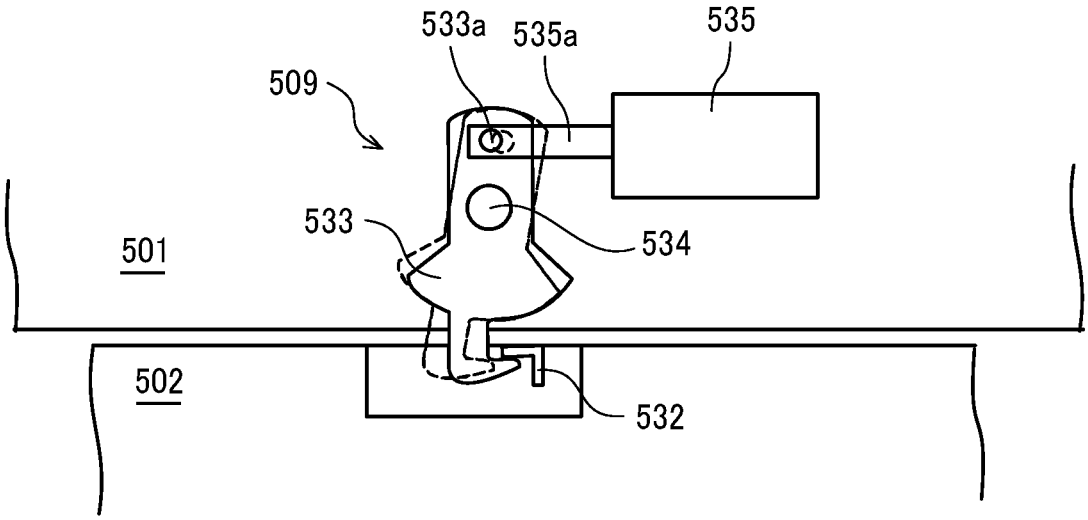
FIG. 14 is a plan view illustrating a door locking device to lock the front door and a device body of the heating device to illustrate the door locking device provided to the heating device.

Next, a description is given of an example of a door locking device of the heating device 500, with reference to FIG. 14.

FIG. 14 is a plan view illustrating a door locking device to lock the front door and the device body of the heating device to illustrate the door locking device provided to the heating device.

The heating device 500 includes a door locking unit 509 that locks the front door 502 that functions as a door, with respect to the device body 501.

The door locking unit 509 includes a lock claw 533 to lock or engage a locking portion 532 (also see FIG. 9) provided on the upper end surface of the front door 502. The lock claw 533 is rotatably held by a shaft 534 with respect to the device body 501. Further, a plunger 535 of a push-type solenoid 535 is coupled by a shaft 533*a* on an opposite side to the side on which the lock claw 533 is engaged with the locking portion 532.

In the door locking unit 509, by changing the solenoid 535 to an active (ON) state, the lock claw 533 is moved to the position indicated by a solid line to engage with the locking portion 532, so that the front door 502 is locked. Further, by changing the solenoid 535 to an inactive (OFF) state, the lock claw 533 is moved to the position indicated by a broken line to disengage from the locking portion 532, so that the front door 502 is unlocked.

Figure 15:
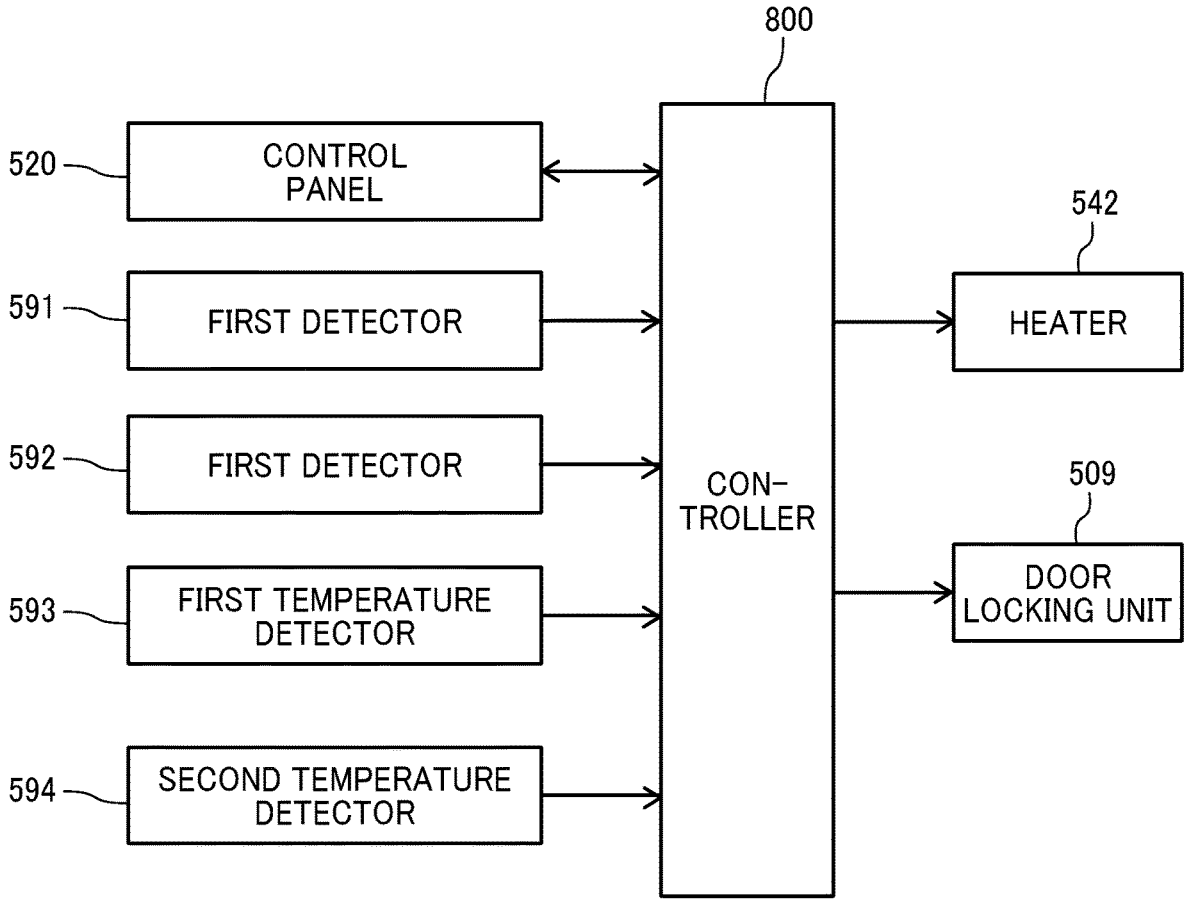
FIG. 15 is a block diagram illustrating a controller provided to the heating device.

Next, a description is given of a controller 800 of the heating device, with reference to FIG. 15.

The controller 800 that functions as circuitry performs control of the heating device 500. The controller 800 acts as a control unit to control heating that is related to this disclosure and another control unit to lock and unlock a locking unit and includes a microcomputer including a central processing unit (CPU), a read-only memory (ROM), a random access memory (RAM), and an input/output (I/O) unit.

The controller 800 controls the power supply (energization) of the heater 542 of the heating unit 504 to produce heat and stop the heat and to control the amount of heat. The controller 800 receives input by key such as the self-luminous pre-heat start key 521*a* and the stop (fixing) key 521*b* on the control panel 520 and controls various displays such as heating-in-progress display 521*c* and the message display unit 522.

The controller 800 inputs a detection signal indicating that the receiver 503 has moved to the non-contact heating position by the first detector 591 and a detection signal indicating that the receiver 503 has moved to the contact heating position by the second detector 592. The controller 800 determines that the operation lever 558 is returned to the standby position when the state of the operation lever 558 is changed from the state in which the operation lever 558 is detected by the first detector 591 or the second detector 592 to the state in which the operation lever 558 is no longer detected by the first detector 591 or the second detector 592.

The controller 800 also receives a detection signal from the first temperature detector 593 and a detection signal from the second temperature detector 594. Here, the first temperature detector 593 detects the temperature of the heater 542 of the heating unit 504 (heater temperature). The second temperature detector 594 detects the temperature relative to the temperature of the fabric 400 that functions as a heating target object, for example, the surface temperature of the fabric 400 and the temperature inside the heating device 500.

The controller 800 also controls the door locking unit 509 that locks the front door 502, so as to lock (close) the front door 502 and to unlock (open) the front door 502.

Figure 16:
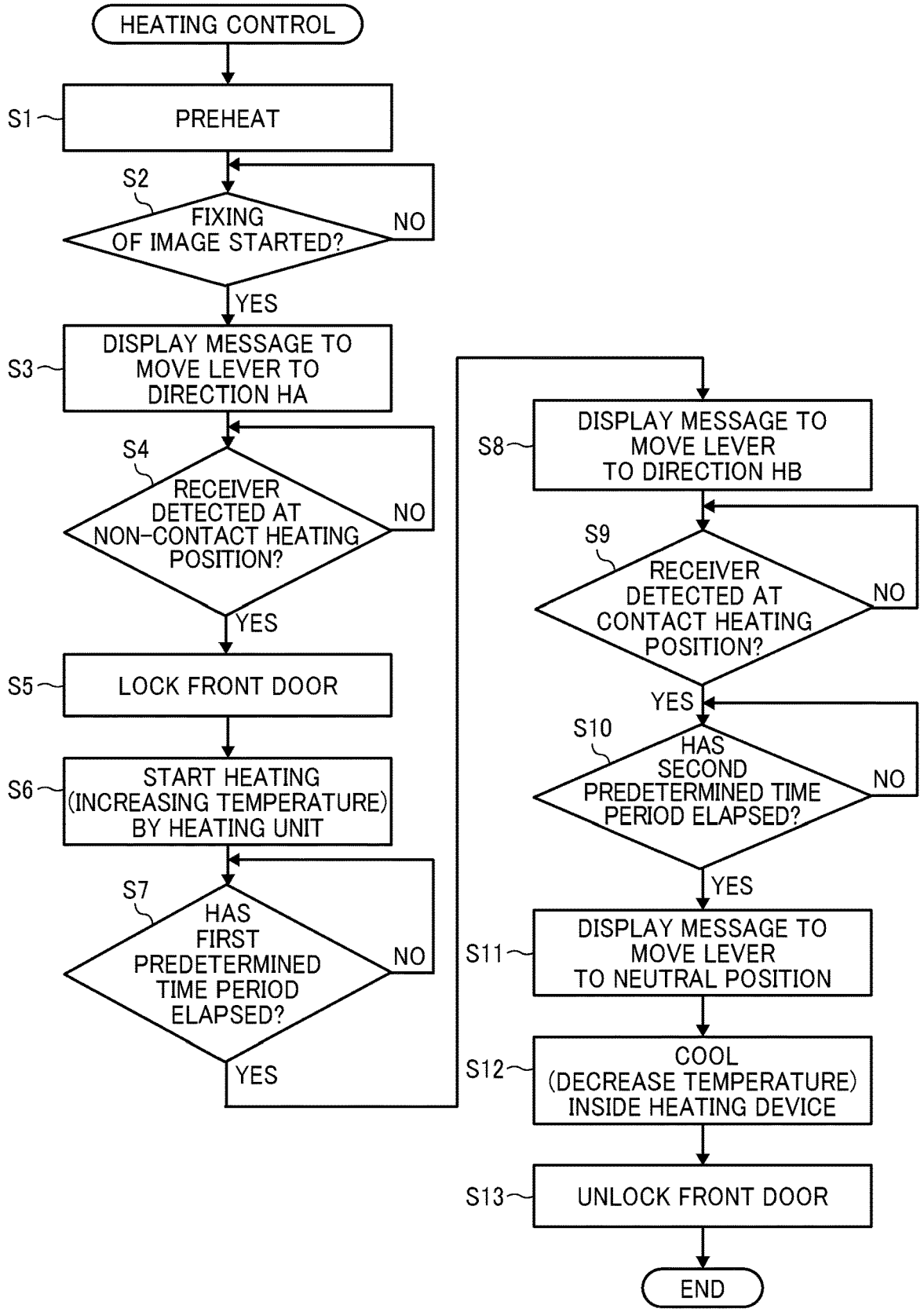
FIG. 16 is a flowchart of the procedure of the heating method according to this disclosure, for heating and fixing a fabric to be heated as a heating target object on which an image is printed using the heating device.

Next, a description is given of the procedure of a heating method according to an embodiment of the present invention, to heat and fix the fabric 400 that functions as a heating target object on which an image is printed by the heating device 500, with reference to a flowchart of FIG. 16.

When the self-luminous pre-heat start key 521*a* is pressed, the controller 800 supplies the power to turn on the heater 542 of the heating unit 504. By so doing, the controller 800 controls preheating to cause the heater temperature to reach a target temperature based on the detection signal of the first temperature detector 593 (step S1).

When the preheating is completed, a user opens the front door 502 of the heating device 500 to, for example, set the cassette 200 that is holding the fabric 400 to which liquid is applied, to the receiver 503 in the heating device 500. After setting the cassette 200 to the receiver 503, the user presses the stop (fixing) key 521*b* to start fixing an image (with liquid) on the fabric 400 (step S2). At this time (Yes in step S2), the controller 800 displays a message, for example, "Please turn the operation lever to the right (that is, to the direction HA)" on the message display unit 522 (step S3).

Therefore, when the user operates (rotates) the operation lever 558 in the direction HA, the receiver 503 is raised to the non-contact heating position. Then, the controller 800 determines whether the first detector 591 detects the receiver 503 is moved up to the non-contact heating position (step S4). In other words, the controller 800 determines whether the first detector 591 detects the receiver 503 at the non-contact heating position. When the first detector 591 detects that the receiver 503 is moved up to the non-contact heating position (Yes in step S4), the controller 800 changes the door locking unit 509 to the locked state, so that the front door 502 is locked (step S5), and causes the heating unit 504 to start heating (increasing the temperature) (step S6).

At this time, the fabric 400 held by the cassette 200 is heated without contact.

Then, the controller 800 determines whether a first predetermined time period has elapsed since the start of heating in the non-contact state (step S7). With this operation, the liquid applied to the fabric 400 is dried. Here, the term "first predetermined time period" indicates a time period in which the liquid on the fabric 400 is in a dry state in which the liquid is not transferred onto the heating unit 504 side when the fabric 400 contacts the heating unit 504 (also referred to as a "first dry state").

In this case, it is preferable that the first predetermined time period is set in advance according to the type of the heating target object and the user inputs the type of the heating target object, to read out the first predetermined time period (heating time) corresponding to the type of the heating target object. In this way, heating target objects having different degrees of drying progress of the liquid is appropriately dried to the first dry state. It is also preferable that the heating temperature of the heating unit 504 is set in advance according to the type of the heating target object.

Then, when the first predetermined time period has elapsed (Yes in step S7), the controller 800 causes the message display unit 522 to display, for example, a message "Please turn the control lever to the left (i.e., in the direction of arrow HB)" (step S8).

At this time, the user operates (rotates) the operation lever 58 to the direction HB, the receiver 503 returns to the standby position and then moves up to the contact heating position. Consequently, the fabric 400 held by the cassette 200 is brought to contact with the heating unit 504 to be heated.

Then, the controller 800 determines whether the second detector 592 detects that the receiver 503 is moved to the contact heating position (step S9). In other words, the controller 800 determines whether the second detector 592 detects the receiver 503 at the contact heating position. When the second detector 592 has detected that the receiver 503 is moved to the contact heating position (Yes in step S9), in other words, when the fabric 400 held by the cassette 200 is brought to contact with the heating unit 504 and is heated, the controller 800 determines whether the second predetermined time period that is set in advance has elapsed (step S10).

In this way, the liquid that is applied to the fabric 400 is dried to another dry state (that is, a second dry state) in which the liquid is fixed to the fabric 400.

Then, after the second predetermined time period has elapsed, the controller 800 displays, for example, a message "Please return the control lever to the neutral position" on the message display unit 522 (step S11). Thereafter, the controller 800 waits (stands by) until the inside of the heating device 500 is cooled (in other words, until the temperature inside the heating device 500 decreases) (step S12). Then, the controller 800 causes the door locking unit 509 to move to the unlock state (in other words, the door locking unit 509 is unlocked) (step S13).

Accordingly, the user removes the cassette 200 from the heating device 500 successfully.

As described above, in the present embodiment, when heating a heating target object (i.e., the fabric 400) to which the liquid is applied, an operation unit (i.e., the operation lever 558) is operated, so that the heating device 500 sequentially performs a non-contact heating process in which the relative position between the receiver 503 and the heating unit 504 is set to the non-contact heating position to heat the heating target object in the non-contact heating position and a contact heating process in which the relative position between the receiver 503 and the heating unit 504 is changed from the non-contact heating position to the contact heating position to heat the heating target object in the contact heating position.

In a comparative heating device, when a heating target object to which liquid being applied is heated to fix an image on the heating target object, if the heating target object is separated from a heating unit to be heated in a non-contact state, it is likely that a fixing time to fix the liquid on the heating target object takes longer. If the heating target object is heated in contact with the heating unit, a liquid is transferred onto the heating unit. Therefore, in order to avoid transfer of liquid onto the heating unit, a transfer prevention sheet such as a silicon paper is to be inserted each time the image is fixed to the heating target object. Consequently, the fixing operation becomes complicated.

By contrast, according to the above-described operations of the present embodiment, by drying the heating target object without contacting the heating target object to a degree at which the liquid is not transferred onto the heating target object and heating the heating target object while the heating target object is in contact with the heating unit, a transfer prevention sheet is not inserted each time the contact heating is performed. Therefore, the fixing operability is enhanced, and the fixing time is reduced.

Figure 17:
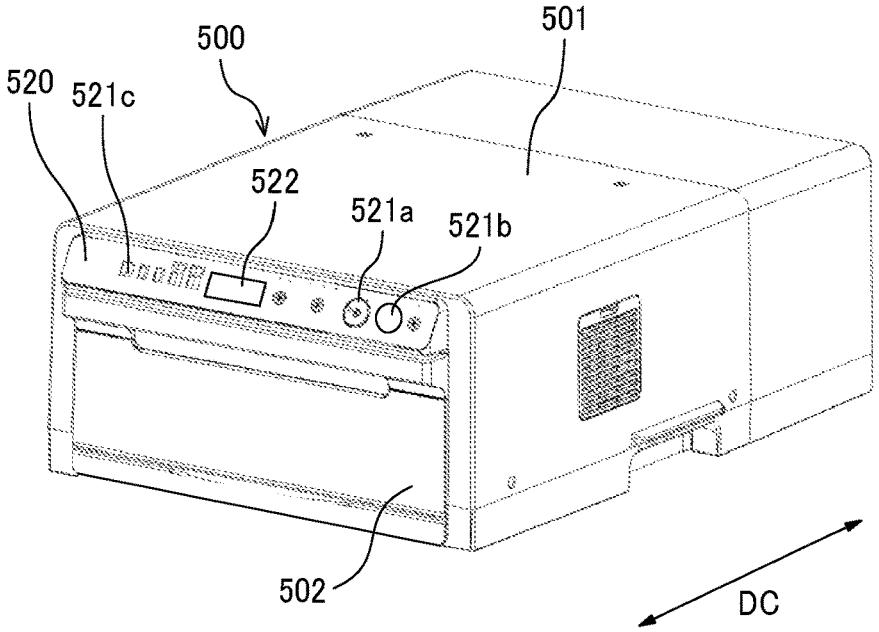
FIG. 17 is an external perspective view illustrating a heating device according to Embodiment 2 of this disclosure.
Figure 18:
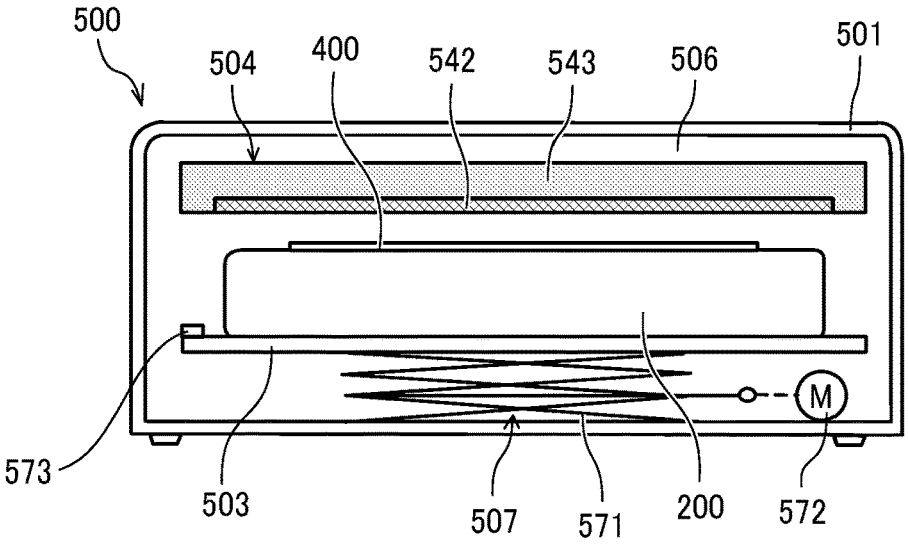
FIG. 18 is a cross-sectional view along the lateral direction (i.e., the direction perpendicular to the direction of insertion and removal of the cassette) of the heating device.

Next, a description is given of a heating device according to Embodiment 2 of this disclosure, with reference to FIGS. 17 and 18.

FIG. 17 is an external perspective view illustrating a heating device according to Embodiment 2 of this disclosure. FIG. 18 is a cross-sectional view along the lateral direction (i.e., the direction perpendicular to the direction, indicated by arrow DC, of insertion and removal of the cassette 200) of the heating device.

In Embodiment 2, the vertical mover 507 includes, for example, a pantograph type jack 571 that functions as a pantograph type vertical mover and a motor 572 to move the pantograph type jack 571 vertically.

Further, the receiver 503 includes a distance measuring sensor 573 to measure a distance between the receiver 503 and the heater 542 of the heating unit 504.

Figure 19:
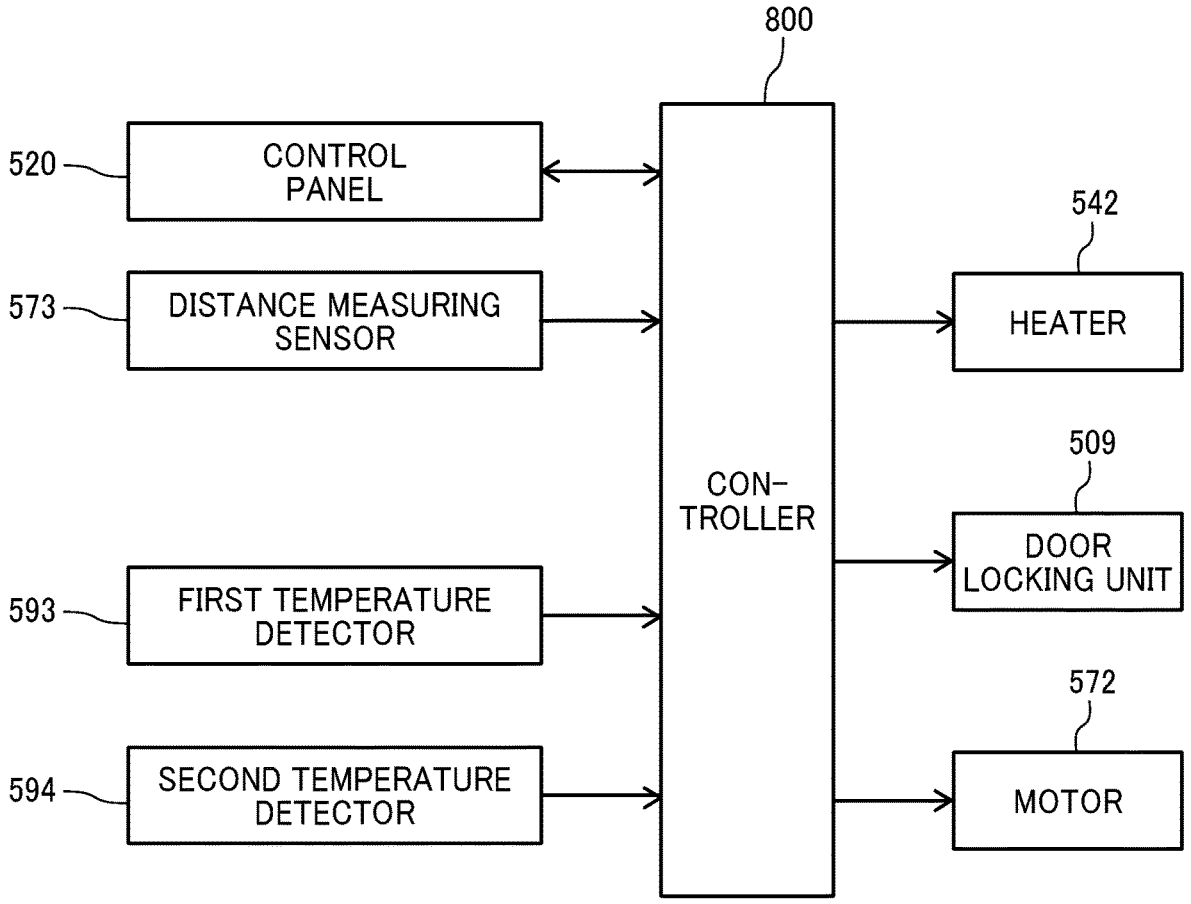
FIG. 19 is a block diagram illustrating a controller provided to the heating device.

Next, a description is given of a controller of the heating device according to Embodiment 2 of this disclosure, with reference to FIG. 19.

FIG. 19 is a block diagram illustrating the controller provided to the heating device.

The controller 800 that functions as circuitry performs control of the heating device 500. The controller 800 acts as a control unit to control heating that is related to this disclosure and another control unit to lock and unlock a locking unit and includes a microcomputer including a central processing unit (CPU), a read-only memory (ROM), a random access memory (RAM), and an input/output (I/O) unit.

The controller 800 controls the power supply (energization) of the heater 542 of the heating unit 504 to produce heat and stop the heat and to control the amount of heat. The controller 800 receives input by key such as the self-luminous pre-heat start key 521*a* and the stop (fixing) key 521*b* on the control panel 520 and controls various displays such as heating-in-progress display 521*c* and the message display unit 522.

The controller 800 drives and controls the motor 572 of the vertical mover 507 to move the receiver 503 up and down relative to the heater 542. At this time, the controller 800 controls the relative position of the receiver 503 to the standby position, the non-contact heating position, and the contact heating position, based on the detection signal of the distance measuring sensor 573.

The controller 800 also controls the door locking unit 509 that locks the front door 502, so as to lock (close) the front door 502 and to unlock (open) the front door 502.

Figure 20:
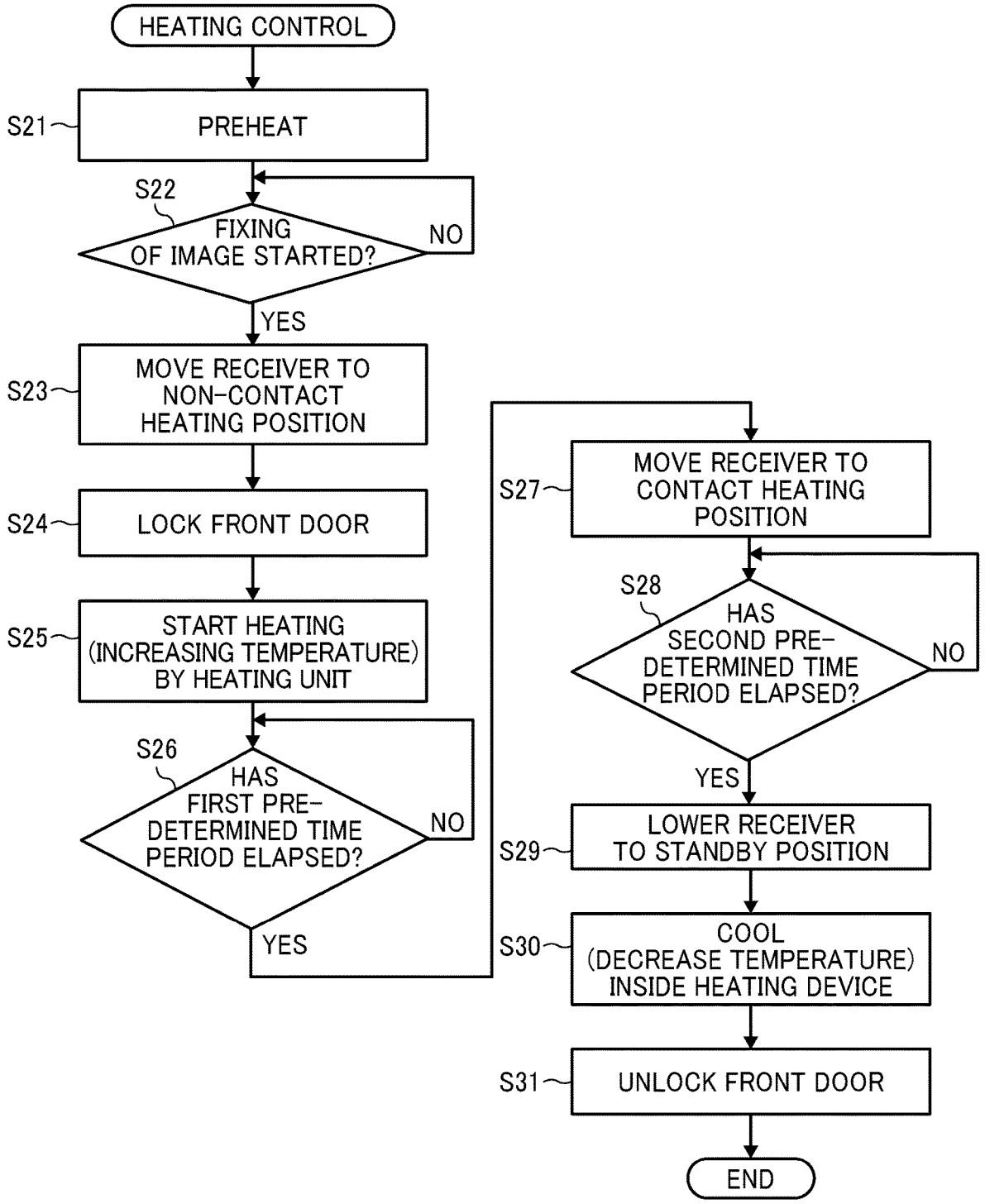
FIG. 20 is a flowchart of the procedure of heating control in the heating device.

Next, a description is given of the heating control of the heating device 500 according to the present embodiment of this disclosure, with reference to FIG. 20.

As the pre-heat start key 521*a* is pressed, the controller 800 supplies power to the heater 542 of the heating unit 504 to activate the heating unit 504 (i.e., to an ON state), and performs the preheating control to cause the heater temperature to reach the target temperature according to the detection signal of the first temperature detector 593 (step S21).

When the preheating is completed, the user opens the front door 502 of the heating device 500 to, for example, set the cassette 200 that is holding the fabric 400 to which liquid is applied, to the receiver 503 in the heating device 500. After setting the cassette 200 to the receiver 503, the user presses the stop (fixing) key 521*b* to start fixing an image (with liquid) on the fabric 400 (step S22).

As the fixing is started (Yes in step S22), the controller 800 causes the receiver 503 to move up from the standby position to the non-contact heating position (step S23), changes the door locking unit 509 to the locked state (step S24), and causes the heating unit 504 to start heating (increasing the temperature) (step S25).

At this time, the fabric 400 held by the cassette 200 is heated without contact.

Then, the controller 800 determines whether the first predetermined time period set in advance has elapsed since the start of heating in the non-contact state (S26). With this operation, the liquid applied to the fabric 400 is dried. Here, the first predetermined time period indicates a time period in which the liquid on the fabric 400 is in a dry state in which the liquid is not transferred onto the heating unit 504 side when the fabric 400 is brought into contact with the heating unit 504 (i.e., the first dry state).

Also in this case, it is preferable that the first predetermined time period is set in advance according to the type of the heating target object and the user inputs the type of the heating target object, so as to read out the first predetermined time period (heating time) corresponding to the type of the heating target object. In this way, heating target objects having different degrees of drying progress of the liquid is appropriately dried to the first dry state. It is also preferable that the heating temperature of the heating unit 504 is set in advance according to the type of the heating target object.

Then, when the first predetermined time period has elapsed (Yes in step S26), the controller 800 further raises the receiver 503 from the non-contact heating position to the contact heating position (step S27). Consequently, the fabric 400 held by the cassette 200 is brought to contact with the heating unit 504 to be heated.

The controller 800 determines whether a second predetermined time period has elapsed since the fabric 400 held by the cassette 200 comes in contact with the heating unit 504 and then is heated (step S28).

Accordingly, the liquid applied to the fabric 400 is dried up to a dry state (i.e., a second dry state) in which the liquid is fixed to the fabric 400.

Then, after the second predetermined time period has elapsed (Yes in step S28), the controller 800 lowers the receiver 503 to the standby position (step S29) and waits until the inside of the heating device 500 is cooled (in other words, the inside temperature of the heating device 500 is lowered) (step S30), and then the door locking unit 509 is unlocked (in other words, the door locking unit 509 is changed to an unlocked state) (step S31).

Accordingly, the user removes the cassette 200 from the heating device 500 successfully.

According to the present embodiment, transition from a non-contact heating state to a contact heating state is automatically performed, and the operability is further enhanced.

It is to be noted that the heating target object holder such as a cassette is not limited to have a box shape, for example, the cassette of the above-described embodiments as long as the heating target object holder has a structure that is detachably attached to a heating device. For example, the fabric holder may be a single plate-shaped platen member that is insertable into the heating device.

Further, a fabric is mainly described in the above-described embodiments. However, this disclosure is not limited to be applied to a fabric but may be similarly applied to the case in which the object to be printed or the object to be heated is a medium. Furthermore, this disclosure can also be applied to a heating device that heats heating a heating target object other than fabric and media.

The embodiments described above are presented as an example to implement this disclosure. The embodiments described above are not intended to limit the scope of the invention. These novel embodiments can be implemented in various other forms, and various omissions, replacements, or changes can be made without departing from the gist of the invention. These embodiments and their variations are included in the scope and gist of the invention, and are included in the scope of the invention recited in the claims and its equivalent.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

What is claimed is:

1. A heating device comprising:

a holder configured to hold a heating target object;

a receiver configured to removably hold the holder;

a heating unit configured to heat the heating target object held by the holder;

a vertical mover configured to move the receiver vertically relative to the heating unit, the vertical mover configured to move the receiver between a non-contact heating position at which the heating target object is heated while the heating target object is separated away from the heating unit, and a contact heating position at which the heating target object is heated while the heating target object is in contact with the heating unit;

the vertical mover comprises a holding table that holds the receiver, and a cam mechanism that vertically moves the holding table;

the cam mechanism includes an operation lever rotatably held in a horizontal direction;

the operation lever includes a first inclined cam portion, and a second inclined cam portion having different heights;

a base surface of the holding table includes first rollers that follow the first inclined cam portion when the operation lever is rotated in a first direction with respect to a stand-by position to move the receiver to the non-contact heating position;

the base surface of the holding table includes second rollers that follow the second inclined cam portion when the operation lever is rotated in a second direction with respect to a stand-by position to move the receiver to the contact heating position; and circuitry configured to control the heating unit, the circuitry configured to:

cause the heating unit to heat the heating target object in a non-contact state in which the receiver is at the non-contact heating position; and cause the heating unit to heat the heating target object in a contact state in which the receiver is at the contact heating position.

2. The heating device according to claim 1, wherein the circuitry is configured to set in advance at least one of a heating time and a heating temperature of the heating unit according to a type of the heating target object.

3. The heating device according to claim 1, wherein the circuitry is configured to preheat the heating unit.

4. The heating device according to claim 3, wherein the circuitry is configured to display a message to a user on a message display unit to rotate the operation lever in the first direction to move the receiver to the non-contact heating position.

5. The heating device according to claim 4, further comprising:

a first detector configured to detect when the operation lever is rotated in the first direction until the receiver reaches the non-contact heating position.

6. The heating device according to claim 5, wherein the circuitry is configured to increase the heat by the heating unit in response to the first detector detecting that the receiver is at the non-contact heating position.

7. The heating device according to claim 6, wherein the circuitry is configured to display a message to the user on the message display unit to rotate the operation lever in the second direction to move the receiver to the contact heating position after a first predetermined time period has elapsed.

8. The heating device according to claim 7, further comprising:

a second detector configured to detect when the operation lever is rotated in the second direction until the receiver reaches the contact heating position.

9. The heating device according to claim 8, wherein the circuitry is configured to display a message to the user on the message display unit to rotate the operation lever to the stand-by position after a second predetermined time period has elapsed.

10. A heating method operable in a heating device that includes:

a holder configured to hold a heating target object a receiver configured to removably hold the holder;

a heating unit configured to heat the heating target object held by the holder; and a vertical mover configured to move the receiver vertically relative to the heating unit, the vertical mover configured to move the receiver between a non-contact heating position at which the heating target object is heated while the heating target object is separated away from the heating unit, and a contact heating position at which the heating target object is heated while the heating target object is in contact with the heating unit;

the vertical mover comprises a holding table that holds the receiver, and a cam mechanism that vertically moves the holding table;

the cam mechanism includes an operation lever rotatably held in a horizontal direction;

the operation lever includes a first inclined cam portion, and a second inclined cam portion having different heights;

a base surface of the holding table includes first rollers that follow the first inclined cam portion when the operation lever is rotated in a first direction with respect to a stand-by position to move the receiver to the non-contact heating position, and second rollers that follow the second inclined cam portion when the operation lever is rotated in a second direction with respect to a stand-by position to move the receiver to the contact heating position;

the method comprising:

rotating the operation lever in the first direction; to move the receiver to the non-contact heating position;

heating the heating target object in a non-contact state in which the receiver is at the non-contact heating position;

rotating the operation lever in the second direction to move the receiver from the non-contact heating position to the contact heating position; and heating the heating target object in a contact state in which the receiver is at the contact heating position.

* * * * *